United States Patent [19]

Russo et al.

[11] Patent Number: 4,921,190

[45] Date of Patent: May 1, 1990

[54] DISPLAY CONSTRUCTION

[75] Inventors: Robert P. Russo, New City; Randolph J. Russo, Nanuet, both of N.Y.

[73] Assignee: Mark Philip Promotions, Inc., Nanuet, N.Y.

[21] Appl. No.: 302,878

[22] Filed: Jan. 30, 1989

[51] Int. Cl.[5] ..... F16M 13/00

[52] U.S. Cl. ..... 248/159; 211/205; 248/121

[58] Field of Search ..... 248/159, 121, 122, 124, 248/125, 158; 211/163, 196, 205, 182; 403/298, 375

[56] References Cited

U.S. PATENT DOCUMENTS

| | | | |
|---|---|---|---|
| 1,464,241 | 8/1923 | Daiger | 211/205 X |
| 2,529,780 | 11/1950 | Miller | 248/159 X |
| 2,789,703 | 4/1957 | Kurtz | 248/159 X |
| 3,759,623 | 9/1973 | Hesse | 248/159 X |
| 3,917,072 | 11/1975 | Bleed | 211/205 X |
| 4,119,044 | 10/1978 | Hines | 248/125 X |
| 4,288,052 | 9/1981 | Scott | 248/158 X |
| 4,586,844 | 5/1986 | Hammonds | 248/159 X |
| 4,678,089 | 7/1987 | Lang | 211/205 X |

*Primary Examiner*—J. Franklin Foss

*Attorney, Agent, or Firm*—Stanley J. Yavner

[57] ABSTRACT

A display construction assembly is provided in order to enable packaging, assembly and transportation ease. The invention focuses on the particular structure of the main display pole of the assembly, wherein segments thereof are connected by use of a connecting insert, preferably made of nylon or other synthetic material, formed to include upwardly and downwardly extending elements from a central, washer-shaped integral flange. The extending elements fit into segments of the main display pole and the washer is either coextensive in outside diameter with the outside diameter of the main display pole, or, in the alternative, extending beyond such outside diameter to better support a rotating part of the display. As a further alternative, all circular cross-section parts of the structure of the present invention can be made square in cross-section, with the same general construction and function as the preferred embodiment.

5 Claims, 1 Drawing Sheet

DISPLAY CONSTRUCTION

BACKGROUND OF THE INVENTION

This invention relates primarily to display structures, and more particularly, to parts of such structures which function as the main, upright display pole thereof.

The display techology has become increasingly important during the past couple of decades with the advent of commercial expositions, the presentation of goods at the point of sale on a display stand, to satisfy long-standing needs with respect to displays, such as in-store merchandise displays, for use as a support base for any structure, all with an attempt to satisfy the modern shipping technology involving the requirement to deliver goods unassembled for purposes of recipient assembly at the intended site of the display. For instance, U.S. Pat. No. 3,863,769, issued Feb. 4, 1975 (filed Dec. 4, 1972), Norman H. Goddard, inventor, shows a construction for connecting together tubular members to be used as garment racks. Goddard used web-slot connections to hold the members together. Not only is the connecting construction different from the present invention, but also the stated function of Goddard is to provide for factory rather than user assembly. In the same manner, U.S. Pat. No. 3,921,813, issued Nov. 25, 1975 (filed Nov. 8, 1974), Alfonse Cimino, inventor, shows a display rack for merchandise having an upstanding post for rotatably mounting a cage for display purposes. The interlocking structure of the upstanding support post is not only different than that proposed by the present invention, but also significantly more complex. Accordingly, the prior art, as represented by such patents and others, does not anticipate the present invention.

Still further, many of the other piror art structures can be represented, particularly as they apply to rotating displays, as including a cotter pin inserted into the upstanding pole for supporting a washer, with a bearing assembly placed over the washer. The upstanding pole in such structures is usually assembled by mating a reduced diameter segment end into a full diameter segment end in various segments of the upstanding pole. In all of this, the structure and assembly requirements for the user are more complex than they are required to.

Accordingly, a primary object of the present invention is to provde a stable display construction, which is easily broken down into segments for shipping convenience.

A further object of the present invention is to provide a display construction, which is convenient to use with rotating displays, as well as presenting ease of assembly in shipment.

A still further object of the present invention is to provide a display construction having a main, upright display pole meeting the previously recited objectives, and, additionally, with the capability for rigid connection of various segments thereof, and yet ease of assembly, dissassembly and for presenting a strong final display product able to perform its display functions in a convenient manner and for use with many different types of displays.

These and other objects of the present invention are satisfied by a main, upright display pole for use in a convenient base structure and for supporting either a rotating display for in-store merchandise, or for supporting any one of a variety of displays. The main, upright display pole includes a plurality of segments each having the same inside diameter and, for over two such segments, a connecting intergral insert having upwardly and downwardly extending elements from a central flange, which is integral with such elements. The insert is formed of nylon or another synthetic material, for mating with the segments of the upright pole usually made of metal or plastic, thereby to present an ease of assembly and disassembly. The outside diameters of the upwardly and downwardly extending elements are coextensive with the inside diameters of the segments. The flange at the approximate center of the insert is either coextensive in outside diameter with the outside diameter of the segments or extending significantly beyond such segment outside diameters in order to support a rotating or other display. Actually, the extent of the flange can be supplied in both forms, so that the user therefo can insert the greater extending flange insert at a height on the main display pole convenient to his or her needs. Also, any circular cross-sectional element of the present invention can just as conveniently be made square in cross-section with the objectives, purposes, functions and construction of the assembly accomplished.

Other objects, features and advantages of the present invention will become apparent by reference to the following detailed description of a preferred, but nonetheless illustrative, embodiment, taken in conjunction with the accompanying drawings, wherein.

DETAILED DESCRIPTION OF THE PREFERRED AND ALTERNATIVE EMBODIMENTS

Figure 1:
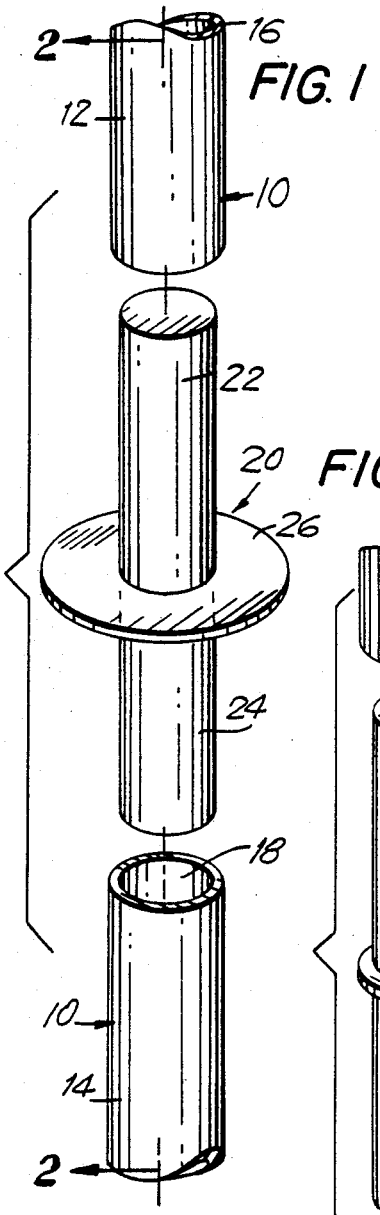
FIG. 1 is a top and front isometric view of the main display pole of a display constructed according to the present invention, showing particularly the segments of the main display pole and the insert for connecting such segments, in exploded view.
Figure 2:
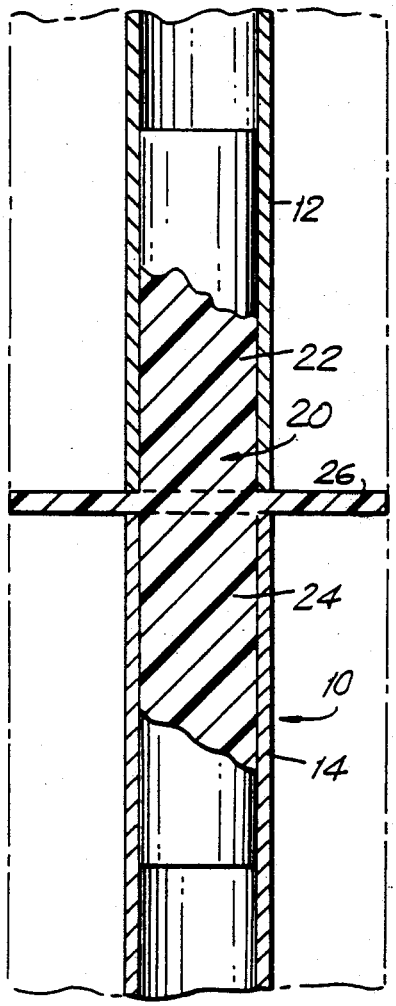
FIG. 2 is a side section view, taken along the line 2—2 of FIG. 1 and showing particularly the assembly of the insert with the main display pole segments.

In accordance with the present invention, the setting for the structure is, for instance, an in-store display, wherein a rotatable wire or metal structure (FIG. 5) is supported by an assembly including a main, upright, display pole, generally designated 10 in FIG. 1, supported by a suitable base (not shown). The base is intended to position the main display pole 10 in an upright position with respect to a floor or other surface and to provide stability to the entire structure.

The main display pole 10 comprises a plurality of segments 12, 14, each being, by way of example of circular cross-section and of generally tubular shape. Accordingly, each segment 12, 14 defines an inside surface 16, 18, having, for each segment 12, the same inside diameter and curvature as other segments 14.

To connect segments, an integral insert, generally designated 20, is provided, the insert 20 having an upwardly extending element 22, and a downwardly extending element 24, such elements being bridged by a central flange 26. The insert 20 is formed of nylon or another synthetic material to provide ease of engagement with the segments of the upright pole 10, which are usually made of metal or plastic. Of course, to further provide ease of assembly and disassembly of the segments with the elements, the outside diameters of the upwardly and downwardly extending elements 22, 24 are coextensive with the inside surfaces 16, 18 of the segments. The diameter of flange 26, at the proximate longitudinal center of insert 20 is either coextensive in outside diameter with the outside diameter of segments 12, 14, or extends significantly beyond such segment outside diameters (e.g.$\frac{3}{4}$"). When flange 26 does so extend beyond the outside diameter of segments 12, 14, it is usually for the purpose of supporting a rotating wire or other display.

Thus, as an example of the present invention, a manufacturer of the present invention receives an order for a versatile support for an in-store rotating display from a retailer or exhibition distributor for a given product line, such as pantyhouse, household small appliances, or the like. The manufacturer's purposes are to provide such a display, which can be used for a plurality of in-store display items. Furthermore, the manufacturer provides a relatively inexpensively shipped structure in terms of weight and size, as well as an ease of assembly for the retailer or distributor. In keeping with this example, he ships main display pole segments 12, 14, etc., each segment being approximately one inch in outside diameter, tubular in shape and approximately ten inches in length. Also, five inserts 20 are shipped, each insert 20 being approximately four to six inches in overall longitudinal size, made of synthetic material such as nylon and, for the upwardly and downwardly extending elements thereof, having an outside diameter coextensive with the inside surfaces 16, 18 of the segments of the main display pole. Three of the five inserts would have a flange diameter conforming to the outside diameter of segments 12, 14, etc., and the fourth and fifth inserts would have an outside diameter for its flange which extends substantially beyond the outside diameter of the segments. Of course, appropriate rubber or plastic end tips (not shown) for the segments would also be provided to finish particularly the top end of the main display pole.

Figure 5:
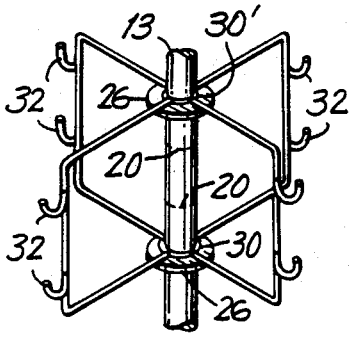
FIG. 5 is an example of a rotating display supported by the main display pole structure according to the present invention.

Also, an appropriate base would be provided, as well as a typical rotating display as exemplified by FIG. 5 of the drawings. It should be noticed that FIG. 5 shows a rotating display having two support surfaces 30, supported longitudinally on flanges 26 of inserts 20. The hooks 32 of the display of FIG. 5 are merely by wayof example to show typically the structure of a rotating display to support a display product.

Upon receipt, the user of the present invention, retailer or a distributor, assemblies the invention by appropriately inserting a main display pole segment 14 into an appropriately structured base. At the top of segment 14, an insert 20 is placed with its downwardly extending element 24 inserted to a position within inside surface 18. Likewise, the upwardly extending element 22 of insert 20 is inserted to a position within another segment 12 so that element 22 is adjacent to inside surface 16. Thus, all that is exposed of insert 20 with the assembly thus far is flange 26. The next insert upwardly on main display pole 10 also has an extended flange 26, but the following inserts, for instance, three more, all have flanges with outside diameters coextensive only with the outside diameters of the segments. In this way, an upright display pole constructed of six segments and five inserts is provided, the lower two inserts having extended flanges 26.

Figure 3:
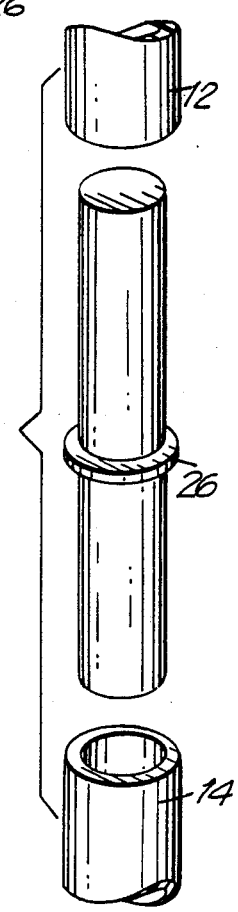
FIG. 3 is an exploded view, similar to that of FIG. 1, but illustrating an alternative embodiment of the insert construction wherein the outside diameter of the flange thereof corresponds to the outside diameter of the segments of the main display pole.

Of course, at a time between the mating of the second and third segments in the manner described above, the rotating display of FIG. 5 is positioned onto the main display pole so that support surface 30 rests on the lowermost extending flange 26. The uppermost extending flange 26 becomes the support for the upper surface 30' of the upper part of the rotating display shown in FIG. 5. The third segment 13 is then positioned with the balance of the assembly, using flanges coextensive with the outside diameter of the segments, in a similar manner. The finished assembly, in its upper part, would appear as shown in FIG. 3.

Figure 4:
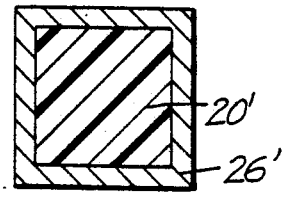
FIG. 4 is a sectional view illustrating an alternative embodiment wherein both the insert and the segments of the main display pole are constructed in square cross-section.

Of course, it is apparent how the invention may be constructed with square segments, square elements of the insert 20' and square flanges 26', as shown in FIG. 4.

Of course, elements, segments and inserts of mixed circular and square cross-section are also encompassed and enabled by the present invention.

The foregoing describes a stable, convenient to ship, easy to assemble and disassemble, and generally useful display main pole for use with an appropriate base and a display, which is only to limited in its scope by the claims appended hereto.

What is claimed is:

1. A display support structure for use with a base and a display for facilitating end user assembly comprising a main display pole, including a plurality of upper and lower segments of given outside peripheral extent with a hollow interior of given inside diameter and an one-piece solid synthetic material insert for each pair of upper and lower segments having upwardly and downwardly extending elements and a central flange, said elements being cylindrical and having a diameter of approximately same value as said given inside diameter and fitting with the upwardly extending element into the upper of said pair of segments and the downwardly extending element into the lower of said pair of segments, the outside extend of said flange at least equalling said given extent;

wherein the outside extent of said flange is substantially greater than said given outside extent, said display being supported by said flange and being rotatable relative to said flange.

2. The invention according to claim 1, wherein the outside extent of said flange equals said given extent.

3. The invention according to claim 1, wherein said segments are generally tubular in shape and said flange is generally circular.

4. The invention according to claim 1, wherein said segments are generally square in cross-section.

5. The invention according to claim 4, wherein said flange is generally square in shape.

* * * * *